United States Patent [19]

Inman

[11] Patent Number: 4,912,785

[45] Date of Patent: Apr. 3, 1990

[54] POOL ACCESSORY DEVICE

[76] Inventor: James L. Inman, 2518 Guebert Rd., Fenton, Mo. 63026

[21] Appl. No.: 182,385

[22] Filed: Apr. 18, 1988

[51] Int. Cl.[4] ..... E04H 3/18

[52] U.S. Cl. ..... 4/496; 15/257 R; 4/488

[58] Field of Search ..... 4/496, 488, 306; 182/129; 248/210, 211, 238; 15/257 R

[56] References Cited

U.S. PATENT DOCUMENTS

| | | | |
|---|---|---|---|
| 1,760,803 | 5/1930 | Wirth | 248/238 |
| 3,088,123 | 5/1963 | Loughridge | 4/496 |
| 3,432,003 | 3/1969 | La Pierre | 182/129 |
| 3,642,240 | 2/1972 | Hershey | 248/210 |
| 4,418,792 | 12/1983 | Cerone | 182/93 |
| 4,429,429 | 2/1984 | Altshul | 15/50 R |
| 4,706,918 | 11/1987 | Wilson | 248/210 |

OTHER PUBLICATIONS

Polaris Installation Procedures for Polaris Ladder/-Guard Rails, FIGS. 1–4.

*Primary Examiner*—Henry J. Recla
*Assistant Examiner*—Edward C. Donovan
*Attorney, Agent, or Firm*—Senniger, Powers, Leavitt and Roedel

[57] ABSTRACT

A device adapted for preventing an automatic pool cleaner from being caught between an interior surface of a pool and a pool ladder having a pair of side rails and a plurality of steps therebetween. The device comprises a body adapted to be positioned between the pool surface and the ladder means for holding the body between the surface and the ladder. The body includes a pair of opposing side walls adapted to span and obstruct the space between the pool surface and the side rails to prevent the pool cleaner from movement into the space.

10 Claims, 2 Drawing Sheets

POOL ACCESSORY DEVICE

BACKGROUND OF THE INVENTION

This invention relates generally to a device for preventing an automatic pool cleaner from becoming caught between an interior surface of a swimming pool and a pool ladder.

Automatic pool cleaners are devices which vacuum debris from the swimming pool as they travel around the interior of the pool. Although automatic pool cleaners are convenient devices they sometimes become trapped in the space between the pool ladder and the pool wall. If left unattended when this occurs, the pool will remain dirty and the cleaner may be damaged due to its being caught.

SUMMARY OF THE INVENTION

Among the several objects of the invention may be noted the provision of a device for preventing an automatic pool cleaner from being caught between the interior surface of a pool and a pool ladder; the provision of such a device which guides the pool cleaner away from the ladder; the provision of such a device which is formed of materials which may be submerged in water; the provision of such a device which is durable and reliable in operation; and the provision of such a device which is buoyant.

Generally, a device of the present invention is adapted for preventing an automatic pool cleaner from being caught between an interior surface of a pool and a pool ladder having a pair of side rails and a plurality of steps therebetween. The device comprises a body adapted to be positioned between the pool surface and the ladder and means for holding the body between the surface and the ladder. The body includes a pair of opposing side walls adapted to span and obstruct the space between the pool surface and the side rails to prevent the pool cleaner from movement into the space.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
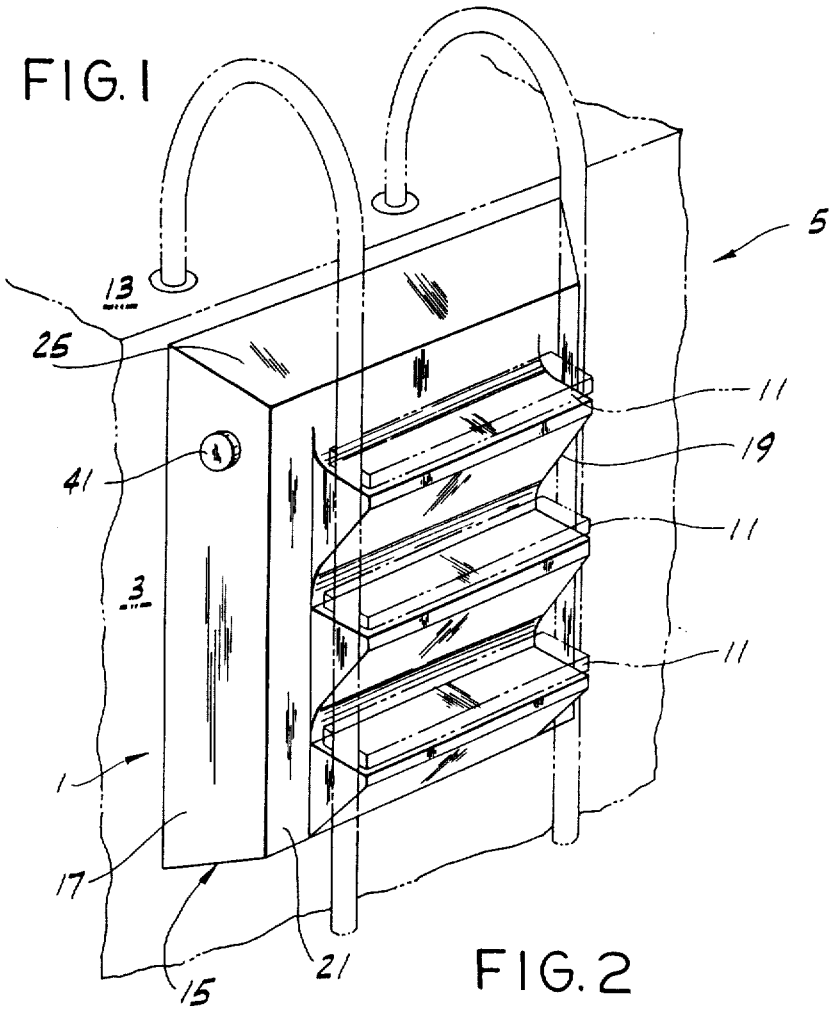
FIG. 1 is a perspective view of a device of the present invention positioned between an interior surface of a swimming pool and a pool ladder having a pair of side rails and a plurality of steps therebetween with the ladder shown in phantom.

Referring now to the drawings, a device of the present invention is designated in its entirety by the reference numeral 1. As shown in FIG. 1, the device 1 is especially adapted for preventing an automatic pool cleaner (not shown) from being caught between an interior surface, such as a pool wall 3, of a pool 5 and a pool ladder 7 having a pair of side rails 9 and a plurality of steps 11 therebetween. Generally, the ladder 7 is secured to a plane surface, such as a pool deck 13, and the ladder 7 extends into the pool 5.

Figure 4:
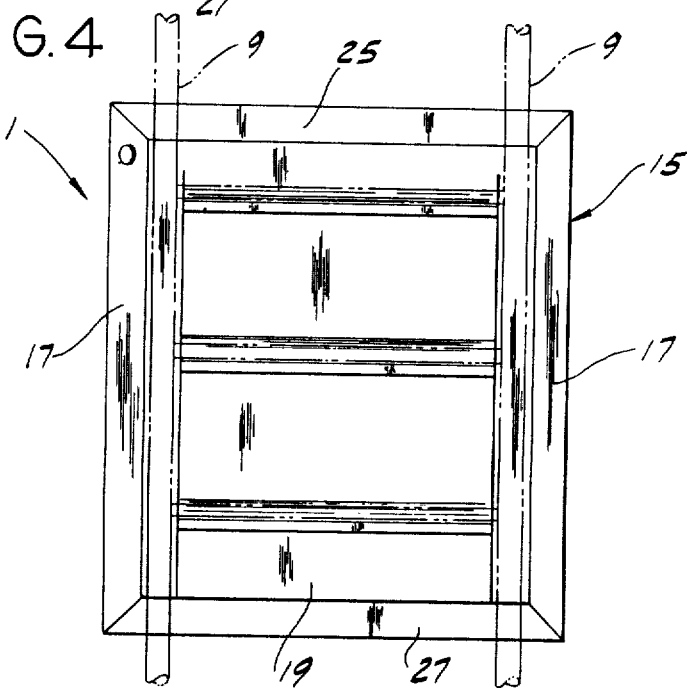
FIG. 4 is a front view of the device of FIG. 1.

The device 1 comprises a body generally designated 15 having a pair of opposing side walls 17 which are adapted to span and obstruct the space between the pool surface 3 and the side rails 9 to prevent the pool cleaner from movement into the space, and means generally designated 19 for holding the body 15 between the wall 3 and the ladder 7. The body 15 also includes a front wall 21 connecting the pair of side walls 17, and a rear wall 23. The side walls 17 diverge from the front wall 21 toward the rear wall 23 to guide the pool cleaner away from the ladder 7, as is shown in FIG. 4. The body 15 may also include an upper wall 25 and a lower wall 27 to define a hollow buoyant body. Preferably, the device 1 is formed of synthetic resin material.

Figure 3:
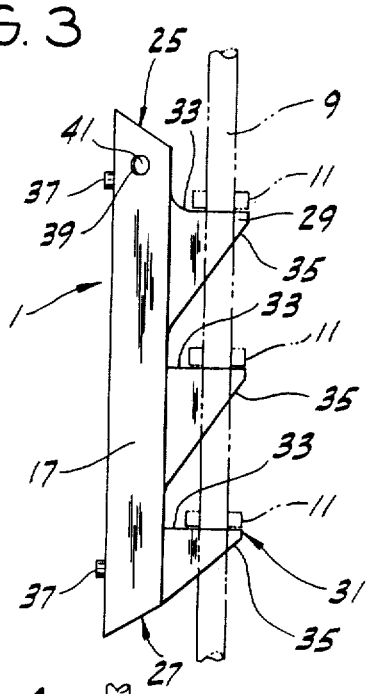
FIG. 3 is a side view of the device of FIG. 1.

The holding means comprises at least one projection 29 extending outwardly for the front wall 21 adapted to engage at least one step 11 to limit movement of the body 15 relative to the ladder 7. Although at least one projection 29 is required, it is preferred to include the same number of projections 29 as there are steps 11 in the ladder 7. As best shown in FIG. 3, the projections 29 are also adapted to engage a bottom 31 of each step 11 and to fit between the side rails 9 to limit sideways movement of the body 15. FIG. 3 also illustrates that the projections 29 are ledges having a top side 33 and an under side 35. The underside 35 is tapered from the top side 33 downwardly and inwardly toward the front wall 21.

Figure 2:
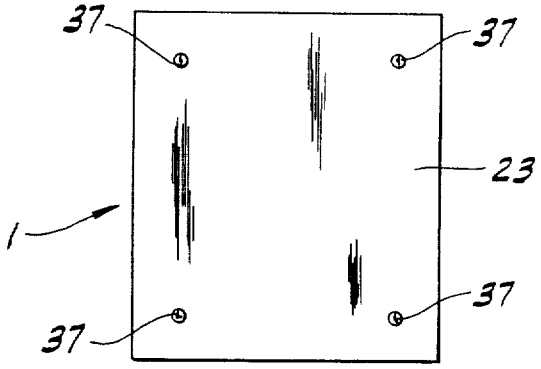
FIG. 2 is a rear view of the device of FIG. 1.

As shown in FIGS. 2 and 3, a plurality of additional projections 37 extend rearwardly from the rear wall 23 for spacing the body 15 from the pool wall 3 to prevent algae from building up between the rear wall 23 and the pool wall 3.

One of the side walls 17 includes an opening 39 for filling or emptying the body 15 with water for adjusting the buoyancy of the body 15. A plug 41 is also provided for closing the opening 39 after the adjustment of the buoyancy has been completed.

In operation, the device 1 is positioned between the pool wall 3 and the ladder 7. The buoyancy of the device 1 may need adjusting to insure that the top surfaces 33 of each projection 29 engage the bottom of each step 11. If necessary, adjustment is accomplished by removing the plug 41 and either filling or emptying the body 15 with water. Although water is specified, any other suitable medium may be used. Once the adjustment has been completed the device 1 will prevent the pool cleaner from being caught between the pool wall 3 and the ladder 7.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A device for preventing an automatic pool cleaner from being caught between the interior surface of a pool and a pool ladder having a pair of side rails and a plurality of steps therebetween, the device comprising a body adapted to be positioned between the pool surface and the ladder, the body having a pair of opposing elongate side walls adapted to extend vertically behind the side rails and an elongate front wall connecting the side walls adapted to extend vertically behind the steps, the side walls adapted to span and obstruct the space between the pool surface and the side rails, the front wall being adapted to span and obstruct the space between the side rails behind the steps thereby to prevent the pool cleaner from movement into said spaces, and means for holding the body between the surface and the ladder, the holding means comprising at least one projection extending outwardly from the front wall of the body and adapted to engage at least one step to limit movement of the body relative to the ladder, the projections comprising ledges having a top side and an under side, the latter being tapered from the top side downwardly and inwardly toward the front wall of the body.

2. The device of claim 1 wherein the body is hollow.

3. The device of claim 1 wherein the body is formed of synthetic resin material.

4. The device of claim 1 wherein there are a plurality of projections adapted to engage the bottoms of steps and to fit between the side rails to limit sideways movement of the body.

5. The device of claim 1 wherein the body includes a rear wall and a plurality of additional projections extending rearwardly therefrom the body for spacing the body from the pool surface to prevent algae from building up between the rear wall and the pool surface.

6. The device of claim 5 wherein the side walls diverge from the front wall of the body toward the rear wall thereof to guide the pool cleaner away from the ladder.

7. The device of claim 1 wherein the body is hollow.

8. The device of claim 1 wherein the body further comprises means for adjusting the buoyancy of the body.

9. The device of claim 7 wherein the holding means comprises at least one projection extending outwardly from the front wall of the body and adapted to engage at least one step to limit movement of the body relative to the ladder.

10. The device of claim 9 wherein the projections are ledges having a top side and an under side, the latter being tapered from the top side downwardly and inwardly toward the front wall of the body.

* * * * *

UNITED STATES PATENT AND TRADEMARK OFFICE

CERTIFICATE OF CORRECTION

PATENT NO. : 4,912,785

DATED : April 3, 1990

INVENTOR(S) : James L. Inman

It is certified that error appears in the above-identified patent and that said Letters Patent is hereby corrected as shown below:

Column 4, line 8, "The device of claim 1 wherein the body is hollow", should read ---A device for preventing an automatic pool cleaner from being caught between the interior surface of a pool and a pool ladder having a pair of side rails and a plurality of steps therebetween, the device comprising a body adapted to be positioned between the pool surface and the ladder, the body having a pair of opposing elongate side walls adapted to extend vertically behind the side rails and an elongate front wall connecting the side walls adapted to extend vertically behind the steps, the side walls adapted to span and obstruct the space between the pool surface and the side rails, the front wall being adapted to span and obstruct the space between the side rails behind the steps thereby to prevent the pool cleaner from movement into said spaces, said body further including a rear wall, an upper wall and a lower wall, said walls defining a hollow buoyant body, and means for holding the body between the surface and the ladder.---

Signed and Sealed this

Third Day of September, 1991

*Attest:*

HARRY F. MANBECK, JR.

*Attesting Officer*

*Commissioner of Patents and Trademarks*